US005402735A

United States Patent [19]

DeJean

[11] Patent Number: 5,402,735

[45] Date of Patent: Apr. 4, 1995

[54] RECYCLABLE PALLET ASSEMBLY

[75] Inventor: Milton V. DeJean, Winston-Salem, N.C.

[73] Assignee: Ingersoll-Rand Company, Woodcliff Lake, N.J.

[21] Appl. No.: 115,952

[22] Filed: Sep. 1, 1993

[51] Int. Cl.[6] ..... B65D 19/00

[52] U.S. Cl. ..... 108/51.1; 108/56.1; 108/902

[58] Field of Search ..... 108/51.1, 51.3, 56.1, 108/901, 902, 56.3

[56] References Cited

U.S. PATENT DOCUMENTS

| | | | |
|---|---|---|---|
| 2,692,107 | 12/1952 | De Ridder et al. . | |
| 3,157,423 | 11/1964 | Brie, Sr. | 108/51.1 X |
| 3,256,839 | 9/1964 | Peterson et al. . | |
| 3,538,861 | 11/1970 | Jurasek . | |
| 3,581,680 | 6/1971 | Fleming | 108/51.1 |
| 3,654,877 | 4/1972 | Barrett . | |
| 4,112,854 | 9/1978 | Pitchford | 108/51.1 X |
| 4,208,971 | 6/1980 | Persson . | |
| 4,715,294 | 12/1987 | Depew | 108/51.1 |
| 4,802,421 | 2/1989 | Atterby et al. | 108/51.1 |
| 4,993,330 | 2/1991 | Yen | 108/51.1 X |
| 5,067,418 | 11/1991 | Carter . | |
| 5,123,359 | 6/1992 | Delbalso . | |
| 5,158,403 | 10/1992 | Moors . | |
| 5,170,722 | 12/1992 | Friesner et al. . | |
| 5,174,448 | 12/1992 | Flaig . | |
| 5,176,090 | 5/1993 | Roberts et al. . | |
| 5,320,048 | 6/1994 | Feiner | 108/51.3 X |

FOREIGN PATENT DOCUMENTS

| | | | |
|---|---|---|---|
| 2056934 | 3/1981 | United Kingdom | 108/51.1 |

*Primary Examiner*—Jose V. Chen
*Attorney, Agent, or Firm*—Victor M. Genco, Jr.

[57] ABSTRACT

A material handling apparatus includes a plurality of runners extruded from a thermoplastic material to a predetermined dimension that is uniquely sized for an individual load to be handled. Each runner defines an upper load supporting surface, an opposed bottom surface having formed therein a tab locating channel, and a pair of opposed lateral surfaces. Each lateral surface has formed therethrough a predetermined number of bar locating apertures. A plurality of bars are extruded from a thermoplastic material to a predetermined dimension that is uniquely sized for the individual load to be handled. The bars are insertably received by a respective bar locating aperture of an individual runner. At least one stabilizer has a main body and a predetermined number of tab members made integral with the stabilizer main body. Each tab member is received by the tab locating channel of an individual runner. A plurality of fastening structure removably mount the at least one stabilizer on the runners.

4 Claims, 2 Drawing Sheets

RECYCLABLE PALLET ASSEMBLY

BACKGROUND OF THE INVENTION

This invention generally relates to pallets, and more particularly to a lightweight, recyclable loading pallet assembly for handling, storing or relocating bulky articles by fork trucks or the like.

Conventional pallets for use in relocating bulky articles are manufactured solidly of wood, and normally a sender of such pallets requests their return. One disadvantage of conventional wooden pallets is that they are relatively heavy which causes high freight rates. Another disadvantage of these pallets is their inability to be repaired when damaged. Further, because of the burgeoning demand on public landfills, the range of disposal options which are available for the damaged pallets are limited. In the past, damaged wooden pallets were chipped or shredded. However, this method of disposal requires that all nails be removed from the pallets, which is an expensive and time consuming process. Additionally, in most instances, stringent environmental regulations now preclude the burning of damaged pallets.

There have been numerous suggestions for the use of paperboard, recycled paperboard or cardboard for the construction of pallets in the prior art. In fact, an entire sub-class of the United States Patent and Trademark Office classification is devoted thereto, i.e., Class 108, sub-class 51.3. However, a loading pallet manufactured from lightweight paperboard is an unacceptable alternative to replace traditional wooden loading pallets in such instances where heavy articles must be relocated, such as machines, compressors or parts therefore.

U.S. Pat. No. 5,170,722 describes a pallet having two interlocking sets of runners which may be formed from recyclable thermoplastics using injection molding or structural foam injection molding techniques. However, this type pallet does not offer a user thereof the flexibility to readily and precisely dimension the pallet assembly to the exact dimensions of a load. For example, if a user requires a pallet having dimensions of 4' by 5', but only a pallet of 4' by 4' can be assembled with a present inventory of sets of runners, additional runners must be manufactured from different sized injection molds. If the required size injection mold is not available, a mold must be specially manufactured, which is quite expensive. Therefore, it is readily apparent that uniquely sizing thermoplastic pallet assemblies for an individual load, using injection molding techniques, may be an expensive and time consuming process.

The foregoing illustrates limitations known to exist in present pallet assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pallet having a plurality of runners individually dimensioned to efficiently interact with a unique load. Each runner has an upper load supporting surface, an opposed bottom surface having formed therein at least one tab locating aperture, and a pair of opposed lateral surfaces. A plurality of support bars are individually dimensioned to efficiently interact with the unique load. A plurality of support bar locating means are formed in predetermined lateral surfaces of the runners for individually locating a respective support bar. At least one stabilizer has a main body and a predetermined number of tab members made integral with the stabilizer main body. Each tab member is received by a respective tab locating aperture of an individual runner. A plurality of fasteners removably mount the at least one stabilizer on the runners.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
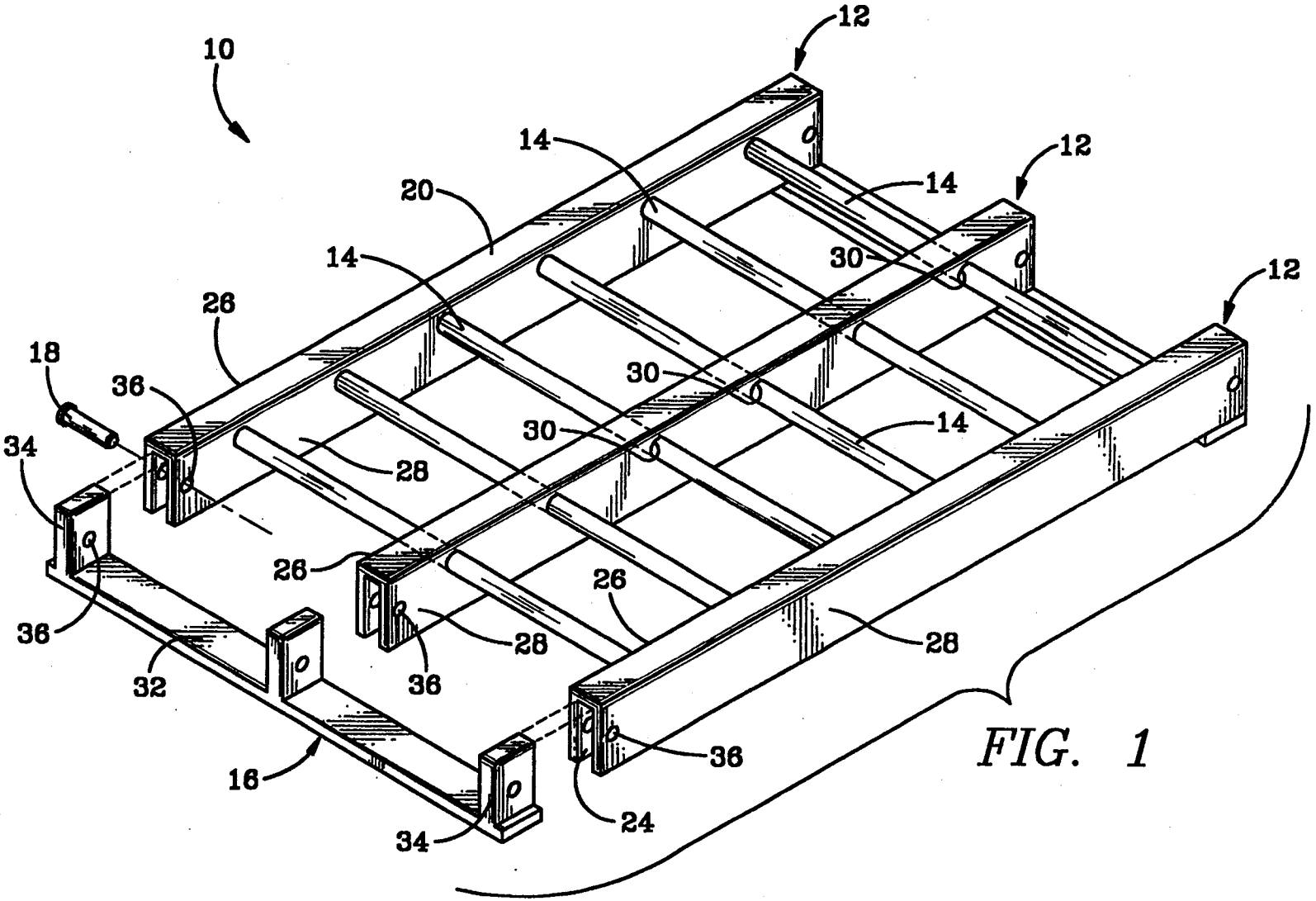
FIG. 1 is a partially exploded, perspective view of the apparatus of the present invention.

Referring now to the drawings, wherein like numerals indicate like elements, there is shown in FIG. 1 a pallet or material handling apparatus 10 according to the present invention. The pallet 10 includes a plurality of runners 12, a plurality of support bars or bar members 14, at least one stabilizer 16, and a plurality of fastening means 18 for removably mounting the at least one stabilizer 16 to the runners 12. As described in further detail hereinafter, the pallet 10, and the method for making the same, permit a user to fabricate a pallet 10 which is uniquely dimensioned to efficiently interact with an individual load (not shown) having predetermined dimensions.

Each runner 12 defines an upper load supporting surface 20, an opposed bottom surface 22, and a pair of left and right lateral surfaces 26,28, respectively. Each runner 12 is extruded from a thermoplastic material, such as polypropylene, polyester, or polyethylene. The extruded thermoplastic runners 12, may be uniquely dimensioned to efficiently interact with an individual load to be handled. Although FIG. 1 illustrates a pallet 10 having three runners 12, any number of runners may be incorporated into a single pallet 10 to provide sufficient structural strength to the pallet for a particular load.

Figure 4:
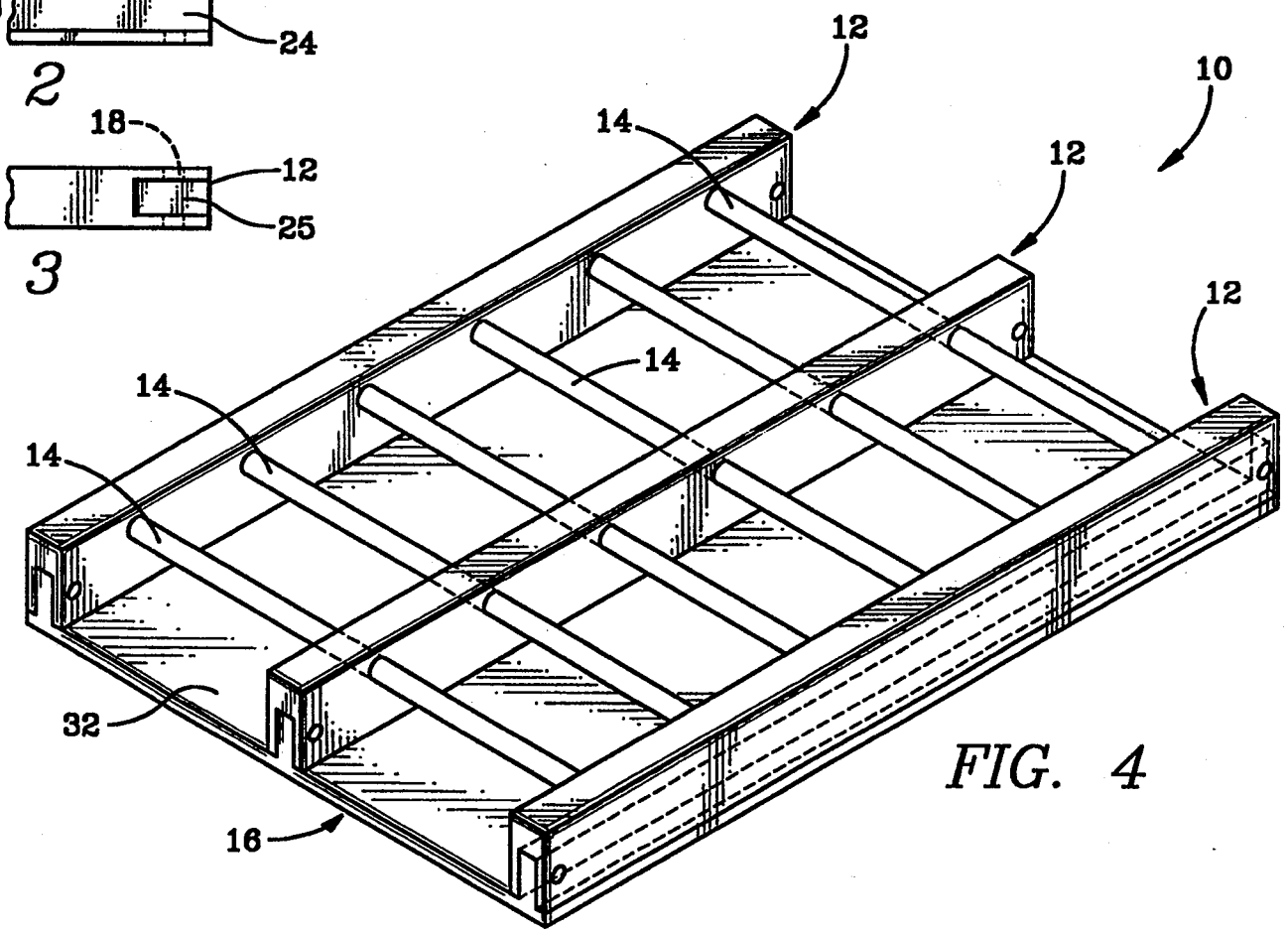
FIG. 4 is a perspective view of an alternate embodiment of the apparatus of the present invention.

Each support bar 14 is extruded from a thermoplastic material, such as polypropylene, polyester, or polyethylene. The extruded thermoplastic bars 14 also may be uniquely dimensioned to efficiently interact with an individual load to be handled. The bars 14 may be extruded into any shape, however, as illustrated in FIGS. 1 and 4, the bars 14 are generally cylindrically shaped. It is anticipated that the bars 14 will be solidly formed to provide superior strength for the pallet 10. Although it is anticipated that hollow bars 14 may be extruded and employed in the pallets 10 in certain instances to reduce the total weight of an individual pallet.

Figure 2:
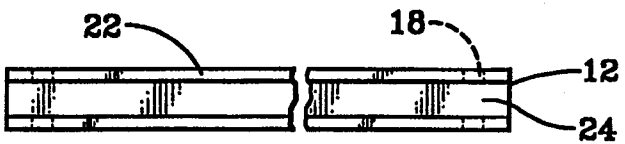
FIG. 2 is a view of a bottom surface of a runner of the present invention having formed therein a channel extending from a first end of the runner to a second runner end.
Figure 3:
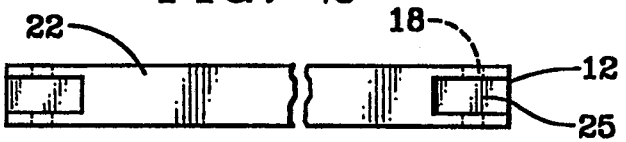
FIG. 3 is a view of a bottom surface of a runner of the present invention having formed therein a plurality of locating apertures.

A means for locating a tab member is formed in the bottom surface 22 of each runner 12. FIG. 2 illustrates one anticipated embodiment of the tab locating means, which is shown as a continuous channel 24 extending from a first end of the runner 12 to an opposite second runner end. The channel 24 may be formed during the extrusion of the runner 12, and may be effective in reducing the overall weight of an individual runner 12. Alternatively, and as illustrated in FIG. 3, a substantially solid runner 12 may be extruded to a predetermined dimension, and thereafter, a plurality of tab locating apertures 25 may be milled into the bottom surface 22 in a predetermined location.

A plurality of support bar locating means 30, such as a plurality of circular shaped holes, are formed in predetermined lateral surfaces of the runners 12. Each support bar locating means of each runner 12 insertably receives a respective support bar 14. As illustrated in FIG. 1, center runners of the pallet 10 have formed through both lateral surfaces 26,28 a bar locating means 30. The outer runners of the pallet 10 only have formed in a respective interior lateral surface a bar locating means 30. By only forming a bar locating means 30 in an interior lateral surface of the outer runners, the individual bars 14 are generally restricted from migrating outwardly, which thereby prevents the individual pallets 10 from disassembling during their use. However, as may be appreciated by one skilled in the art, a bar locating means 30 may be formed through both lateral surfaces 26,28 of the outer runners if a means is provided to prevent bar migration, such as a limiting pin (not shown) or the like.

In one embodiment of the pallet 10 illustrated in FIG. 1, a pair of stabilizers 16 are provided to support the runners 12 and the bars 14. Each stabilizer 16 has a main body 32 and a predetermined number of tab members 34 which are made integral with the stabilizer main body. Each tab member 34 is insertable into a respective tab locating means of an individual runner 12, such as the channel 24 or the individual tab locating apertures 25. The stabilizers 16 may be formed by any number of methods, such as, but not limited to injection molding techniques, fabrication from a lightweight metal, such as aluminum, or by extruding a thermoplastic. Whatever the fabrication method employed to form the stabilizer 16, the number of tab members 34 should equal the number of runners 12 which are incorporated into an individual pallet 10.

FIG. 4 illustrates an alternate embodiment of the present invention wherein a single stabilizer 16 is employed to provide support for the pallet 10. For this embodiment of the pallet 10, it is anticipated that the stabilizer 16 will be fabricated from a lightweight material, such as aluminum, for example, to minimize any additional weight added to the total weight of an individual pallet from the increased size of the stabilizer 16.

As illustrated in the Figures, a plurality of individual fastener locating apertures 36 are formed at predetermined locations through each lateral surface 26,28 of each runner 12 and through each tab member 34. Each individual fastener locating aperture 36 is suitably dimensioned to insertably receive an individual fastening means 18, such as a pin for example, which thereby permits a stabilizer 16 to removeably mount on a runner 12. Accordingly, the pallet 10 is uniquely designed to be disassembled after use so that it may be easily shipped back to an owner/sender of the pallet for its reuse. Additionally, in such instances when an individual runner 12, bar 14, or stabilizer 16 becomes unusably damaged, the pallet 10 may be easily disassembled, the damaged pallet part replaced, and the pallet re-assembled for use in a minimum period of time.

It is anticipated that the apparatus of the present invention is uniquely suited to be manufactured on-site at a manufacturing facility to enable the manufacturing facility to fabricate pallets as needed, to fabricate pallets to unique dimensions as determined by individual loads to be handled, and to provide a manufacturing facility with an on-site capability to recycle damaged pallets into additional usable pallets for handling materials.

In operation of an on-site pallet fabrication system for producing pallets uniquely dimensioned to efficiently interact with an individual load, a thermoplastic grinding machine or chipper, and a thermoplastic extrusion machine will be employed. The thermoplastic grinding machine or chipper is generally known in the art, and will function to prepare damaged pallet parts for the extrusion process by converting the damaged pallet parts from a solid piece to a plurality of plastic shreds or chips. Once in a usable form for the extrusion machine, the shreds or chips are fed to the extrusion machine, which is of a type generally known in the industry. It is anticipated that the extrusion machine will be equipped to extrude thermoplastic pellets supplied by a thermoplastic supplier, such as thermoplastic pellets made from recycled thermoplastics, and to extrude the thermoplastic shreds or chips prepared on-site from the thermoplastic grinding machine.

Before fabricating an individual pallet, the dimensions of an individual load are determined. Thereafter, thermoplastic shreds, chips, or pellets are extruded to form a predetermined number of individual runners 12 and bars 14 dimensioned to optimize handling of the unique load. Each runner and bar is extruded to form a shape as described hereinabove. Bar locating apertures are formed in predetermined lateral surfaces of each runner, such as by a drill, for example. The individual bars 14 are insertably positioned in respective bar locating apertures such that the bars are oriented generally perpendicular to the individual runners. At least one stabilizer 16 is next fabricated and shaped as described hereinabove. Thereafter, each tab member of the at least one stabilizer is insertably positioned into a stabilizer locating channel. In completion of the pallet fabrication process, the at least one stabilizer is removably mounted on a respective runner by fastening methods which have been described hereinabove.

While this invention has been illustrated and described in accordance with a preferred embodiment, it is recognized that variations and changes may be made therein without departing from the invention as set forth in the following claims.

Having described the invention, what is claimed is:

1. A pallet for use in handling a unique load, the pallet comprising:

at least two extruded thermoplastic runners dimensioned to efficiently interact with the unique load, each runner having opposed first and seconds ends, an upper load supporting surface, an opposed bottom surface, and a pair of opposed lateral surfaces, and formed in the bottom surface of each runner is a continuous channel extending from the first end of each runner to the second end, and formed through the opposed lateral surfaces of each runner, in predetermined locations, are a plurality of fastener receiving apertures;

a plurality of extruded thermoplastic support bars;

a plurality of support bar locating apertures formed in predetermined lateral surfaces of the runners, for individually locating a respective support bar;

at least two stabilizers having a main body which includes a predetermined number of tab members, each tab member having a first end which is formed integrally with the stabilizer, an opposed second end, and opposed lateral surfaces which have formed therethrough a plurality of fastener receiving apertures, each stabilizer having a number of tab members equal to the number of extruded thermoplastic runners, and wherein each tab member is dimensioned to be insertably received at a predetermined location within the continuous channel of an individual runner; and a plurality of fasteners for removably mounting the at least one stabilizer on the runners.

2. A material handling apparatus comprising:

a plurality of runners extruded from a thermoplastic material to a predetermined dimension that is uniquely sized for an individual load to be handled, each runner defining an upper load supporting surface, an opposed bottom surface, having formed therein a continuous channel extending from a first runner end to a second runner end, and a pair of opposed lateral surfaces having formed therethrough, in predetermined locations, a plurality of fastener receiving apertures;

a plurality of extruded thermoplastic support bars;

a plurality of support bar locating apertures formed in predetermined lateral surfaces of the runners, each support bar locating aperture insertably receiving a respective support bar;

at least one stabilizer having a main body which includes a predetermined number of tab members formed integrally with the stabilizer main body, each stabilizer main body having a number of tab members equal to the number of extruded thermoplastic runners of the material handling apparatus, each tab member having formed therethrough a plurality of fastener receiving apertures; and a plurality of fastening means for removably coupling the at least one stabilizer with the runners.

3. A method of manufacturing a pallet comprising the following steps:

determining the dimensions of a unique load to be handled;

extruding a thermoplastic material to form a predetermined number of individual runners sized to efficiently interact with a unique load, each runner extruded to form a shape that defines an upper load supporting surface, an opposed bottom surface having formed therein a tab locating channel, and a pair of opposed lateral surfaces;

extruding a thermoplastic material to form a predetermined number of individual bars sized to efficiently interact with the unique load;

forming through predetermined lateral surfaces of each runner a predetermined number of bar locating apertures to permit each runner to insertably mate with each of the bars in a generally perpendicular orientation;

insertably positioning the individual bars in respective bar locating apertures;

forming at least one stabilizer having a main body and a predetermined number of tab members made integral with the stabilizer main body;

insertably positioning each tab member of a stabilizer into the stabilizer locating channel; and removably mounting each tab member on a respective runner.

4. A method of manufacturing a pallet comprising the following steps:

extruding a thermoplastic material to form a predetermined number of individual runners, each runner having an upper load supporting surface, an opposed bottom surface, and a pair of opposed lateral surfaces;

forming in the bottom surface of each runner at least one tab locating aperture;

forming through the opposed lateral surfaces of each runner a predetermined number of bar locating apertures;

extruding a thermoplastic material to form a predetermined number of individual bars;

insertably positioning the individual bars in the bar locating apertures;

forming at least one stabilizer having a main body and a predetermined number of tab members made integral with the stabilizer main body;

insertably positioning each tab member of a stabilizer into a respective at least one tab locating aperture.

* * * * *